US005201272A

United States Patent [19]

Simon

[11] Patent Number: 5,201,272

[45] Date of Patent: Apr. 13, 1993

[54] DEVICE AND PROCESS FOR DETECTING, IN A MACHINE, THE POSITION OF CONTACT OF TWO PARALLEL-AXIS ROLLERS

[75] Inventor: Pierre Simon, Orleans, France

[73] Assignee: Komori-Chambon, Orleans la Source, France

[21] Appl. No.: 858,343

[22] Filed: Mar. 26, 1992

[51] Int. Cl.[5] ..... B41F 13/24

[52] U.S. Cl. ..... 101/485; 101/216; 101/247; 101/153; 73/768; 73/862.49; 73/862.55; 340/682; 384/517; 384/519

[58] Field of Search ..... 101/248, 212, 216, 217, 101/485, 247, 153; 73/768, 862.47, 862.48, 862.49, 862.55, 862.62, 865.54; 340/682; 384/479, 517, 519, 448, 40, 46, 264, 274

[56] References Cited

U.S. PATENT DOCUMENTS

| | | | |
|---|---|---|---|
| 2,212,820 | 8/1940 | Barber | 101/247 |
| 3,272,122 | 9/1966 | Behringer | 101/247 |
| 3,601,046 | 8/1971 | Motter | 101/247 |
| 4,406,169 | 9/1983 | Ikeuchi et al. | 340/682 |
| 4,419,901 | 12/1983 | Ruppert et al. | 73/862.49 |
| 4,657,412 | 4/1987 | McLarty et al. | 384/517 |
| 5,109,768 | 5/1992 | Lubke et al. | 101/153 |

FOREIGN PATENT DOCUMENTS

| | | |
|---|---|---|
| 2368357 | 5/1978 | France . |

*Primary Examiner*—Eugene H. Eickholt
*Attorney, Agent, or Firm*—McAulay Fisher Nissen Goldberg & Kiel

[57] ABSTRACT

The present invention relates to a device for detecting, in a machine, the position of contact of two rollers of parallel axes of which at least one is mounted mobile. This device is characterized in that it comprises an elastic member mounted so as to undergo, during contacting of the two rollers, a deformation, limited by a bearing, further to the relative displacement of two elements mobile with respect to each other, and means for measuring this deformation.

7 Claims, 3 Drawing Sheets

DEVICE AND PROCESS FOR DETECTING, IN A MACHINE, THE POSITION OF CONTACT OF TWO PARALLEL-AXIS ROLLERS

FIELD OF THE INVENTION

The present invention relates to a device for detecting, in a machine, the position of contact of two rollers of parallel axes, of which at least one is mounted to move, parallel to its axis, on the frame of the machine, applicable more particularly but not exclusively, to rotary printing machines, as well as to a process for placing in parallel the axes of two cylinders in contact with each other, with the aid of such a detection device.

BACKGROUND OF THE INVENTION

In a rotary printing machine of the offset type, a web of material to be printed, such as paper or cardboard, passes at constant speed between two parallel rollers, tangential to each other, namely a blanket roller and a counter-roller or another blanket roller. The counter-roller is made of hard material, whilst the superficial layer which constitutes the blanket proper is made of supple material. During printing of the web, the two rollers are applied under pressure against each other so that the layer of supple material of the blanket roller is crushed in its zone of contact with the counter-roller, the magnitude of such crushing depending on the pressure exerted by the counter-roller on the blanket roller.

In order to obtain good-quality printing, it is necessary that the supple superficial layer of the blanket roller be crushed by a known, predetermined value. To obtain this predetermined crushing value, it is therefore necessary previously to determine the position of simple contact, without pressure, between the hard counter-roller and the blanket roller with supple superficial layer, with the web of material gripped therebetween. This position of simple contact, also called "zero" position, which varies as a function of the thickness of the web, serves as basis for the additional stroke of the counter-roller, of which stroke the value is predetermined and gives, further to the crushing of the supple superficial layer of the blanket roller, the desired pressure between the two rollers with the web to be printed passing therebetween.

This reference position or "zero" position was heretofore determined by rule of thumb, for each web thickness, by the operator of the machine. To that end, the operator rotates the blanket roller, in that case moved away from the counter-roller, and he engages between the two rollers a piece of the web to be printed or a piece of material having the same thickness, then he moves the counter-roller towards the blanket roller until contact is established. The instant of this simple contact, without pressure, is determined at the moment when the piece of web which is itself then in contact with the peripheral surfaces of the two rollers, is taken along as it is gripped between the two rollers. It then suffices for the operator to mark this position "zero" and to take it as basis for subsequent adjustment in pressure, translated by the predetermined crushing of the peripheral layer of the blanket roller.

It is clear that this manual, rule of thumb method of determining the "zero" position is not convenient to carry out. It is an object of the present invention to overcome this drawback by providing a device for automatically detecting this "zero" position.

SUMMARY OF THE INVENTION

To that end, this device for detecting, in a machine, the position of contact of two rollers of parallel axes, of which at least one is mounted to move, parallel to its axis, over the frame of the machine, applicable more particularly but not exclusively to rotary printing machines, each of the two rollers being mounted to rotate about its axis and being borne by a respective support shaft of which the end parts are borne by bearings, the bearings of the mobile roller being mounted to move under the control of respective position-adjusting mechanisms, is characterized in that it comprises an elastic member mounted so as to undergo, when the two rollers come into contact, a deformation limited by a bearing, further to the relative displacement of two elements mobile with respect to each other, and means for measuring this deformation.

The invention also relates to a process for placing in parallel the axes of two rollers of which at least one is mobile, with the aid of a detection device as specified hereinabove, characterized in that a first bearing of the mobile roller, located on a first side of this roller, is firstly displaced in the direction of the other roller until the mobile roller comes into contact with the other roller; the position attained by the mobile roller, on this first side, during contacting of the two rollers, is measured, from the deformation of an elastic member, and is memorized; the first bearing, located on the first side of the mobile roller, is displaced in opposite direction, to return it into starting position; and these operations are repeated for the second mobile bearing located on the second side of the mobile roller, so as to measure and memorize the position of contact between the two rollers, on the second side thereof; and, after having returned the second mobile bearing into starting position, the two mobile bearings are again displaced simultaneously in order to bring them both into their positions of contact measured previously, which ensures parallelism of the axes of the two rollers.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
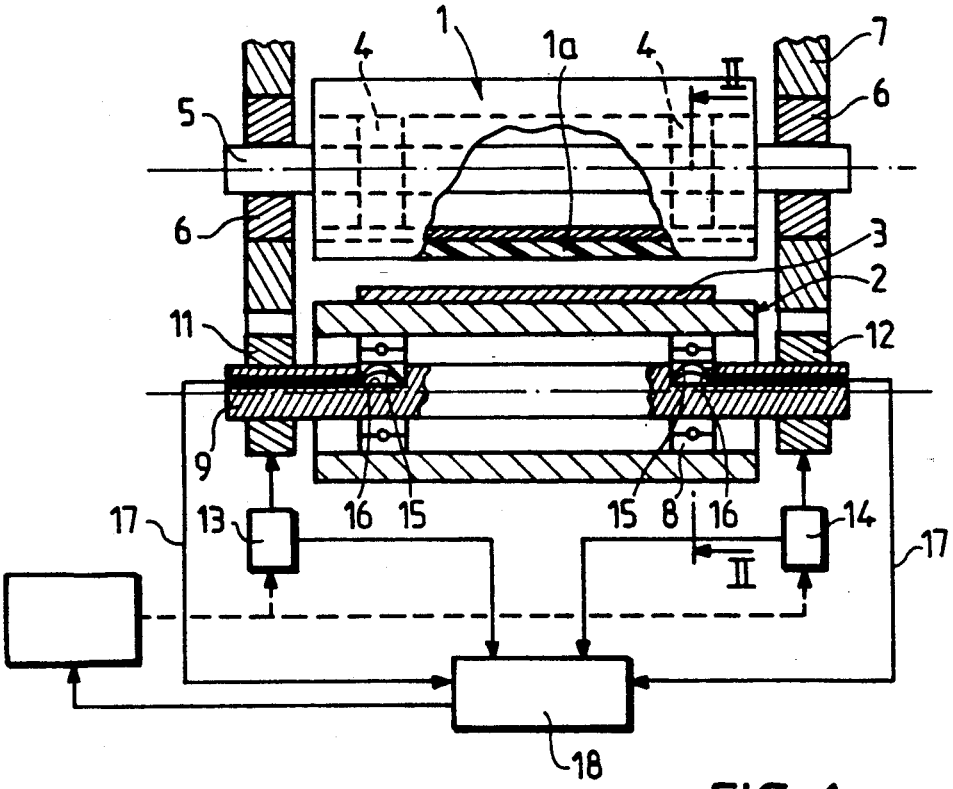
FIG. 1 is a schematic view in vertical and transverse section (with respect to the web) of a detection device according to the invention used in an offset rotary printing machine of which only the lower part is shown, comprising the superposed blanket and counter-rollers, which are shown spaced apart from each other, i.e. offset without pressure.
Figure 2:
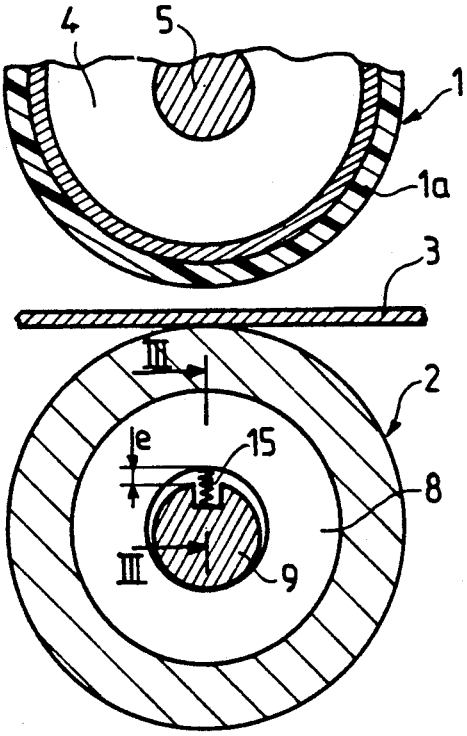
FIG. 2 is a view in vertical, longitudinal section (with respect to the web), on a larger scale, along line II—II of FIG. 1.
Figure 3:
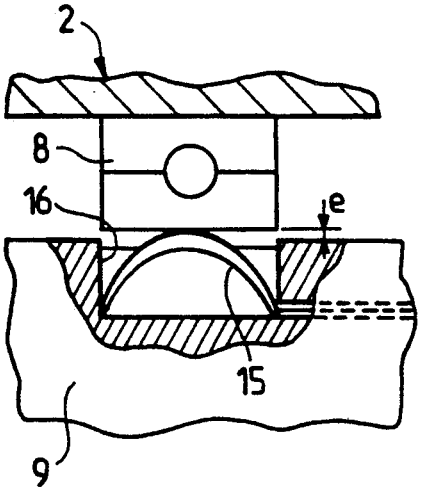
FIG. 3 is a view in vertical section, on a still larger scale, along line III—III of FIG. 2.
Figure 4:
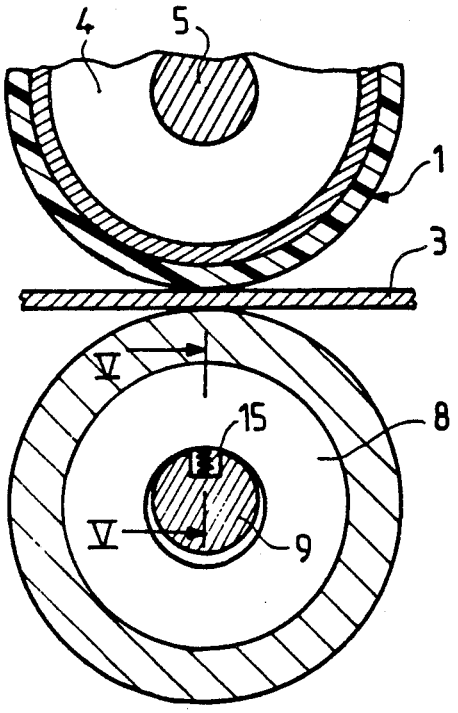
FIG. 4 is a view in vertical and longitudinal section, similar to that of FIG. 2, the two counter-and blanket rollers being shown in position of simple contact or "zero" position.
Figure 5:
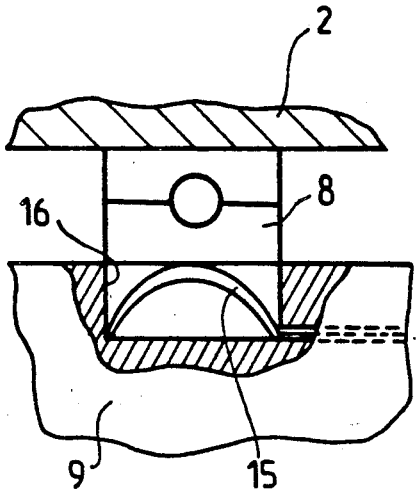
FIG. 5 is a view in vertical section, on a larger scale, along line V—V of FIG. 4.

Referring now to the drawings, and firstly to FIGS. 1 to 5, a non-limiting application will now be described of the detection device according to the invention, to an offset rotary printing machine of which only the lower part is shown in FIG. 1. This printing machine comprises two horizontal parallel rollers disposed one above the other, namely an upper blanket roller 1 and a lower counter-roller 2, between which cylinders a web of material 3 to be printed passes. The upper blanket roller 1 is mounted to rotate, via roller bearings 4, on a support shaft 5 which extends transversely (with respect to the web 3) between two fixed bearings 6 borne by uprights of the frame 7 of the printing machine. The blanket roller 1 conventionally comprises a superficial layer 1*a* of supple material.

The lower counter-roller 2 is mounted on the frame 7 of the printing machine so as to be able to be displaced vertically. The counter-roller 2, made of hard material, is mounted to rotate, via roller bearings 8, on a support shaft 9 transverse with respect to web 3. The two opposite ends of shaft 9 of the counter-roller 2 are borne by respective bearings 11, 12 which may be displaced vertically over the frame 7 of the printing machine, independently of each other, under the control of respective individual adjusting mechanisms 13, 14. Such mechanisms may be of any known type, for example incorporating rotating screw and nut.

According to the invention, the roller bearings 8 of the lower counter-roller 2 or detector roller are mounted on the support shaft 9 with a slight radial clearance e. In other words, the inner diameter of each roller bearing 8 is greater than the outer diameter of the shaft 9 by value e. Furthermore, each roller bearing 8 of the counter-roller 2 is urged in the direction of the blanket roller 1, i.e. upwardly, by elastic means 15 which are housed in hollows 16 formed in the peripheral surface of the shaft 9, at the place where the roller bearings 8 are mounted. Each hollow 16 is located on the upper side of the shaft 9, i.e. on that side of this shaft turned towards the upper blanket roller 1. The force exerted by the elastic means 15 on the inner cage of each roller bearing 8 is just sufficient to compensate the weight of the counter-roller 2 and to maintain it normally slightly raised with respect to its support shaft 9, as has been shown in exaggerated manner in FIG. 2, the maximum clearance e in that case being present totally above the shaft 9.

The detection device according to the invention also comprises means for locating the cancellation of the clearance e in the upper part of the support shaft 9. These means for detecting the variation of the clearance may be constituted by the elastic means 15 themselves, in that case made in the form of strain gauges subject to bending forces. These strain gauges are cambered so as to be in contact with the inner cage of each roller bearing 8 and to urge it upwardly, i.e. towards the upper blanket roller 1. According to a variant, independent means, of any known type, for example an electrical contact, which perform the same function, may, however, be envisaged. Each strain gauge 15 is connected, by a lead 17 passing through shaft 9, to a circuit 18 comprising a memory for storing signals resulting from deformations of gauges 15.

A detailed description will now be given of the manner in which the detection device according to the invention determines the reference position or "zero" position of the two rollers 1 and 2, in which they are just in contact, without application of a pressure, with the web 3 of material to be printed gripped between the two. In starting position, the different constituent elements occupy the positions shown in FIGS. 1 to 3 and the two blanket and counter-rollers 1 and 2 respectively are spaced apart from each other. The detector counter-roller 2, in low position, is then raised, with respect to its support shaft 9, under the action of the elastic means 15 urging the roller 2 upwardly. In order to determine the "zero" position, the operator controls an oblique rise of the shaft 9, provoking, for example, in the first place, a rise of the left-hand bearing 11 via the left-hand adjusting mechanism 13. As soon as the left-hand part of the detector counter-roller 2, with the web 3 that it bears, comes into contact with the lower left-hand part of the blanket roller 1, this blanket roller 1, which is maintained fixed on the frame 7 of the machine, performs the role of stop opposing any additional upward movement of the left-hand part of the counter-roller 2. This results in the left-hand roller bearing 8 being immobilized and as the left-hand bearing 11 continues to rise slowly, under the action of the adjusting mechanism 13, the left-hand part of the support shaft 9, moving upwardly, provokes a compression of the elastic means 15 located in the hollow 16 located in the left-hand part of the shaft 9. This relative upward movement of the left-hand part of the shaft 9 is translated by a complete taking-up of the clearance e at that spot and the relative movement of the shaft 9 with respect to the immobilized left-hand roller bearing 8 is then detected by the appropriate means provided to that end, which gives an indication of the fact that the "zero" position, simple contact without pressure, has been attained. This indication may be furnished by the deformation of the left-hand strain gauge 15 placed in the left-hand hollow 16, if such a strain gauge performs the double function of elastic means urging a roller bearing 8 and of element for measuring the strain. To that end, the left-hand strain gauge is connected, by lead 17, to the circuit 18 comprising a memory, to store a signal emitted by the gauge 17, when it is deformed in flexion, this signal representing the "zero" position in the left-hand part of the machine.

Once this first measurement made, the operator causes the left-hand bearing 11 and the left-hand part of shaft 9 to redescend to their starting position, by means of the adjusting mechanism 13. He then proceeds in the same way in the right-hand part of the machine, causing the right-hand bearing 12 to rise until the "zero" position is likewise attained and the corresponding signal is transmitted by the right-hand gauge 15 to the circuit 18, and then causing this bearing to redescend.

After these operations, the memory circuit 18 contains data corresponding to the "zero" positions obtained in the left- and right-hand parts of the machine. It then suffices for the operator to raise the two left-hand (11) and right-hand (12) bearings simultaneously until the predetermined "zero" positions are attained in the manner described hereinabove. One is then certain that the axes of the two rollers 1 and 2 are perfectly parallel to each other. The web 3 of material to be printed is then just in contact with the surfaces of the two rollers 1 and 2, without being subjected to a pressure. Thereafter, the operator controls an additional simultaneous upward displacement of the two bearings 11 and 12, over the same distance, to obtain a predetermined known value of the crushing of the supple superficial layer 1*a* of the blanket roller 1 corresponding to a print of good quality.

Figure 6:
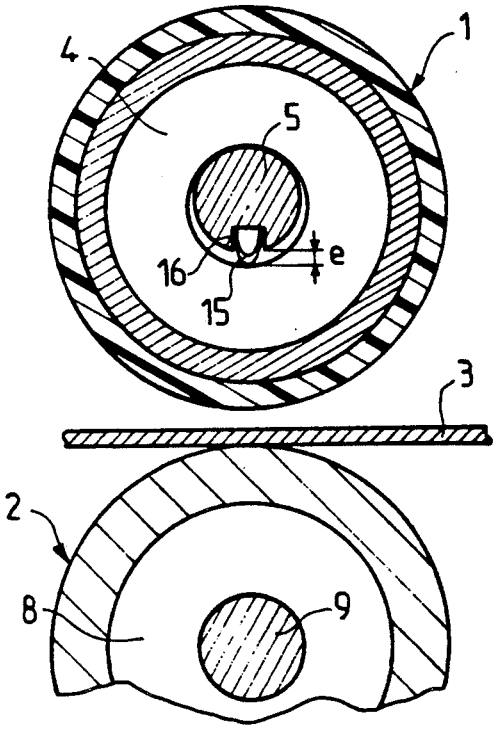
FIGS. 6 and 7 are views in vertical, longitudinal section, similar to FIGS. 2 and 4, respectively, of a variant embodiment of the detection device according to the invention.
Figure 7:
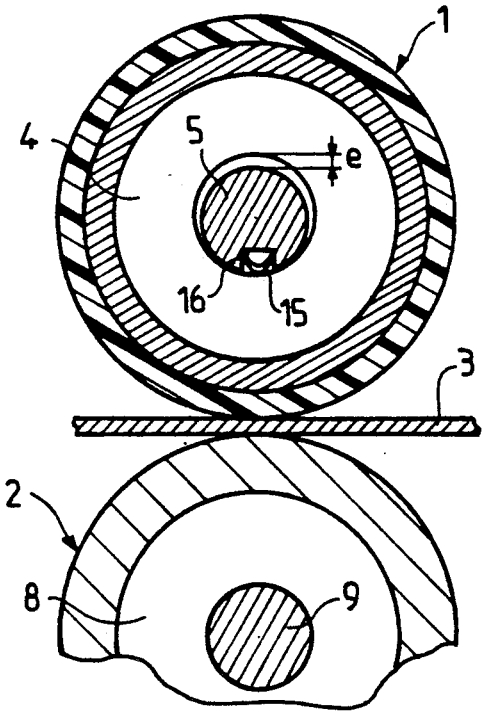
Figure 8:
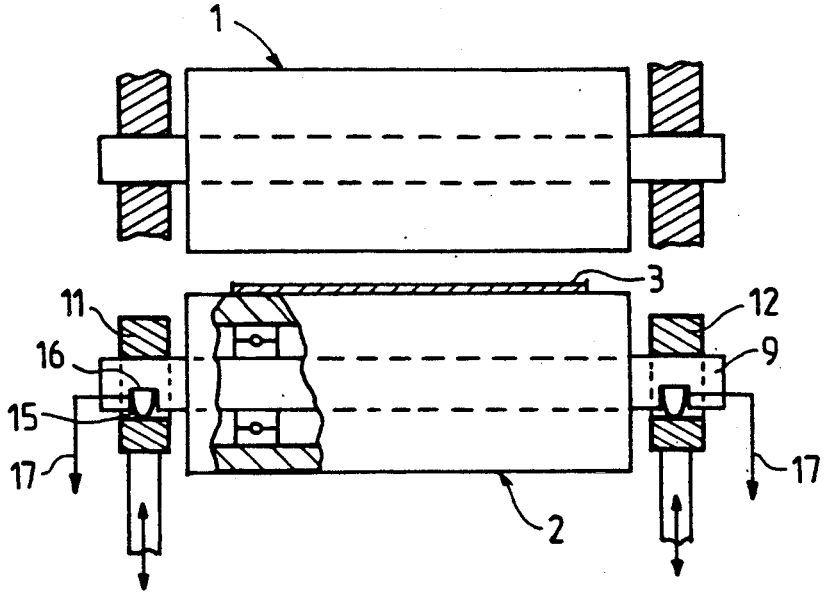
FIGS. 8 and 9 are schematic views in elevation, partially in section, of another variant embodiment of the detection device according to the invention, of which the strain gauges are respectively in nondeformed and deformed positions.
Figure 9:
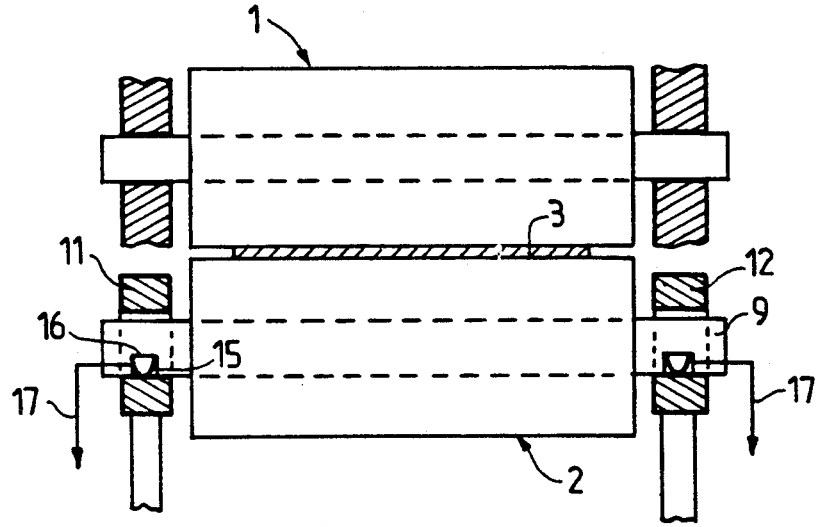
Figure 10:
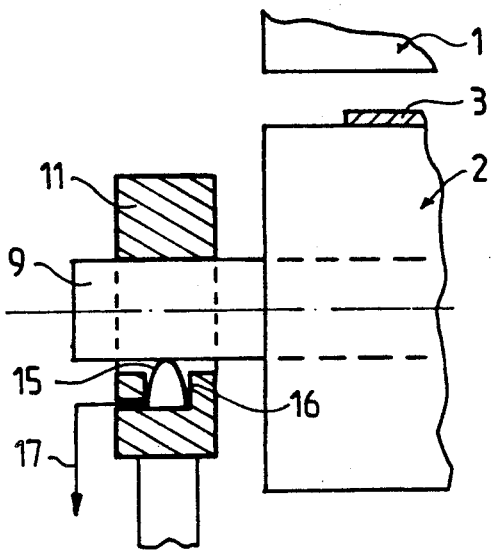
FIGS. 10 and 11 are part-sectional views of another variant embodiment of the detection device, of which the strain gauges are respectively in nondeformed and deformed positions.
Figure 11:
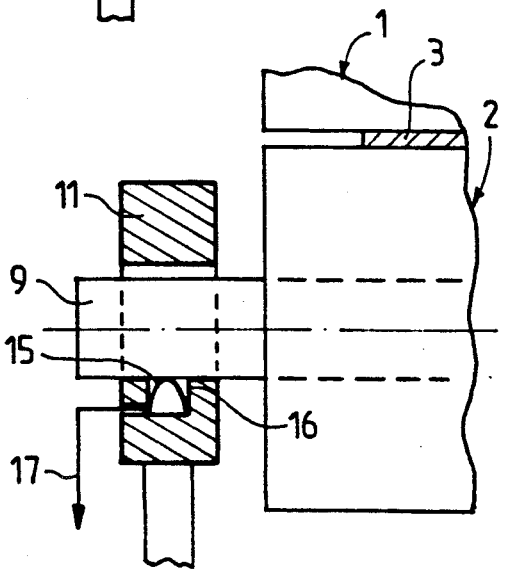

In the variant embodiment shown in FIGS. 6 and 7, the lower counter-roller 2 is mounted without clearance on its shaft 9 whilst the upper blanket roller 1 is mounted on a shaft 5 with clearance e and performs the role of detector roller. In this case, the hollows 16 housing the strain gauges 15 in flexion are formed in the lower part of the shaft 5 of the upper roller 1, i.e. on the side facing the lower roller 2. The maximum clearance e is then formed beneath the shaft 5, when the two rollers 1 and 2 are spaced apart from each other (FIG. 6), solely under the action of the weight of the upper detector roller 1, and the strain gauges 15 are compressed when the lower roller 2 arrives in "zero" position (FIG. 7).

FIGS. 8 to 11 show variant embodiments, in which the strain gauges 15 are housed, no longer inside the mobile roller 2, but in the mobile bearings 11, 12 supporting the ends of the support shaft 9. This embodiment of the invention may be more particularly applied to the case of "shaft" rollers, i.e. of which the support shafts 5, 9 are fast with the cylindrical bodies and rotate in bearings 6, 11. Consequently, the maximum clearance e is provided between the end parts of the support shaft 9 and the bores of bearings 11, 12. In the embodiment shown in FIGS. 8 and 9, the strain gauges 15 are housed in hollows 16 provided in the end parts of the support shaft 9. In the variant embodiment shown in FIGS. 10 and 11, the strain gauges 15 are housed in hollows 16 formed in the inner surface of each mobile bearing, as shown in the case of the mobile bearing 11.

Although the foregoing description concerns the application of the invention to the detection of the "zero" position of the vertically mobile counter-roller of an offset rotary printing machine, it goes without saying that the device for detecting this "zero" position may be applicable in other domains, whenever it is desired to mark the position of simple contact, without pressure, of two parallel cylinders. In the example described hereinabove, it is the lower roller 2 which alone is mounted to move vertically with respect to the upper roller 1 mounted fixed on the frame of the machine. However, the reverse arrangement may also be envisaged, the "zero" position then being detected on the vertically mobile upper roller, moving towards the lower roller maintained fixed on the frame of the machine. The "zero" position detection device according to the invention may also be used with a machine in which the rollers are both mounted mobile on the frame of the machine.

Furthermore, the device for detecting the position of contact of the two rollers and the process for placing the axes of the two rollers in parallel, may be employed both in the case where a web passes between the two rollers and in the case of such a web being absent, the two rollers in that case being directly tangential to each other.

What is claimed is:

1. A device for detecting, in a machine, the position of contact of two rollers having parallel axes, at least one of said rollers being a mobile roller mounted to move, parallel to its axis, over a frame of the machine, each of the two rollers being mounted to rotate about its axis and being borne by a respective support shaft having end parts borne by bearings, the bearings of the mobile roller being mounted to move under control of respective position-adjusting mechanisms, comprising:

elastic means mounted relative to one of said rollers, said elastic means being adapted to undergo a deformation said elastic means being limited by a bearing, further to a relative displacement of two mutually mobile means relative to each other, and means for measuring said deformation.

2. The device of claim 1, wherein one of said two mobile means with respect to each other is constituted by a support shaft supporting the mobile roller, whilst the other element is constituted by a roller bearing disposed between the support shaft and the body of the mobile roller.

3. The device of claim 1, wherein one of the said two mutually mobile means comprises a shaft supporting a mobile cylinder, whilst the other of said mobile means comprises a bearing in which is mounted an end part of a support shaft.

4. The device of claim 1, wherein one of said elastic means includes a deformable elastic member comprising a strain gauge.

5. The device of claim 4, wherein one of said two mutually mobile elements is provided with a hollow, and said strain gauge is housed in said hollow and said strain gauge is cambered so as to project from said hollow and to be contact with said other mobile means.

6. The device of claim 4, including a circuit comprising a memory for storing a signal representing the position of contact between the two rollers, and a lead connecting said strain gauge to said circuit.

7. A process for placing in parallel the axis of two rollers, at least one of said rollers being mobile, with the aid of a detection device, comprising the steps of:

firstly displacing a first bearing associated with said mobile roller, located on a first side of said mobile roller, in the direction of the other roller until the mobile roller comes into contact with the other roller;

measuring a deformation of an elastic member associated with said mobile roller, and memorizing the position attained by the mobile roller, on this first side, during contacting of the two rollers;

displacing said first bearing, located on said first side of the mobile roller, in opposite direction, to return said mobile roller to its starting position;

repeating these operations for a second mobile bearing located on a second side of the mobile roller, so as to measure and memorize the position of contact between the two rollers, on the second side thereof; and after having returned the second mobile bearing to said starting position, again displacing the two mobile bearings simultaneously in order to bring them both into their positions of contact measured previously, which ensures parallelism of the axes of the two rollers.

* * * * *